United States Patent [19]

Gruaz

[11] 4,199,057

[45] Apr. 22, 1980

[54] CONTAINER FOR EXPLOSIVE CARTRIDGES

[76] Inventor: Eric Gruaz, 4, avenue Marechal Foche 69006, Lyon, France

[21] Appl. No.: 918,400

[22] Filed: Jun. 23, 1978

[30] Foreign Application Priority Data

Jul. 18, 1977 [FR] France ..... 77 22484

[51] Int. Cl.[2] ..... F42B 37/00

[52] U.S. Cl. ..... 206/3; 86/1 R; 206/523; 206/589

[58] Field of Search ..... 86/1 R; 206/3, 523, 206/589

[56] References Cited

U.S. PATENT DOCUMENTS

| | | | |
|---|---|---|---|
| 3,713,360 | 1/1973 | Shansey | 86/1 R |
| 3,731,585 | 5/1973 | Demberg et al. | 86/1 R |
| 3,813,987 | 6/1974 | Minneman | 206/3 X |

*Primary Examiner*—Leland A. Sebastian
*Attorney, Agent, or Firm*—Karl F. Ross

[57] ABSTRACT

A container for holding a plurality of explosive cartridges has a base over which fits a cover. The base has an upper face and is formed with a plurality of recesses each having a shape generally complementary to that of one of the cartridges but formed along its full height with an extension. Each of these recesses and its extension opens only at the respective face so that a cartridge fitted in any one of the recesses can be aired via the respective extension at the upper face of the base. The cover has a lower face juxtaposable with the upper face and formed with a ridge that normally spaces these faces apart. This cover has a skirt engaging down around the base and formed with at least one groove extending through the ridge to the upper face so that the space between these faces is open to the outside through this groove.

10 Claims, 5 Drawing Figures

CONTAINER FOR EXPLOSIVE CARTRIDGES

FIELD OF THE INVENTION

The present invention relates to a container. More particularly this invention concerns a box for holding explosive cartridges such as ammunition, blanks, shotgun shells, or firing caps.

BACKGROUND OF THE INVENTION

The production and storage of explosive cartridges entails the considerable risk of explosion. In particular a so-called chain explosion can occur wherein one cartridge explodes and sets off others.

A principal manner of overcoming this problem has been the production of the explosives in aqueous solutions. Thus during the production the likelihood of explosion is almost completely ruled out. After production, however, it is necessary to store the cartridges in such a manner that they can dry, yet without the likelihood of any accidental or spontaneous explosion of one cartridge setting off another.

OBJECTS OF THE INVENTION

It is therefore an object of the instant invention to provide an improved container for holding a plurality of explosive cartridges.

Another object is the provision of such a container in which the objects can be stored and dried with minimal possibility of a chain explosion.

SUMMARY OF THE INVENTION

These objects are attained according to the instant invention in a container comprised of a base and a cover. The base has an upper face and is formed with a plurality of recesses each having a shape generally complementary to that of one of the cartridges but formed along its full length with an extension. Each of these recesses with its extension opens upwardly only at the face, so that a cartridge fitted in any of the recesses can be aired at the respective extension but there is no communication laterally below the face from one recess to the next. In this manner a chain explosion is unlikely. The cover has a lower face juxtaposable with the upper face of the base and is formed with a ridge spacing these two faces apart. This cover further has a skirt engaging down around the base and formed with a groove extending through the ridge to the lower face of the cover. Thus the space between the faces is open to the outside through the groove and the cartridges can therefore be aired through the extensions, the space, and the groove.

According to further features of this invention each of the recesses is substantially cylindrical and slightly longer than the respective cartridge it is intended to receive. The extensions extend along the respective recesses and impart to them a keyhole section. The recesses are therefore blind, with the bottom surface of the base being below the bases of the recesses.

Thus with the system according to the instant invention the cartridges can dry easily and at the same time the likelihood of any chain explosion is greatly reduced. No buildup of moisture or vapors inside the container is possible.

According to further features of this invention the base and cover are both generally rectangular and the cover is formed with two such grooves. In such an arrangement the above-described ridge is merely constituted as a step within the skirt of the cover, and the two grooves are opposite. The open ends of these grooves therefore make gripping the base and pulling it out of the cover relatively easy.

Both the cover and the base according to this invention are made of an easily moldable synthetic resin, polystyrene foam being eminently suitable. This allows the container to be produced at very low cost and to be itself very light.

SPECIFIC DESCRIPTION

Figure 1:
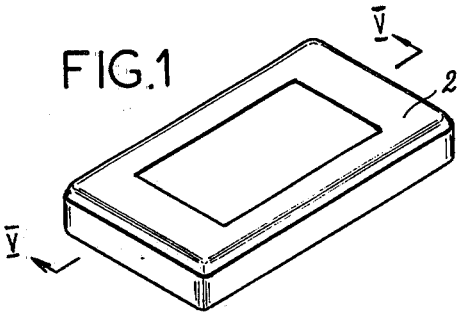
FIGS. 1 and 2 are top and bottom perspective views of the container according to this invention.
Figure 2:
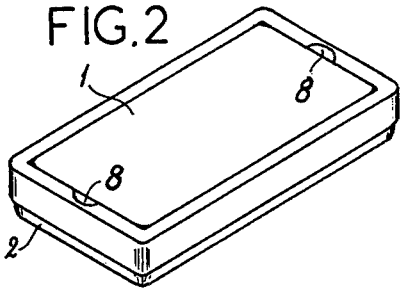
Figure 3:
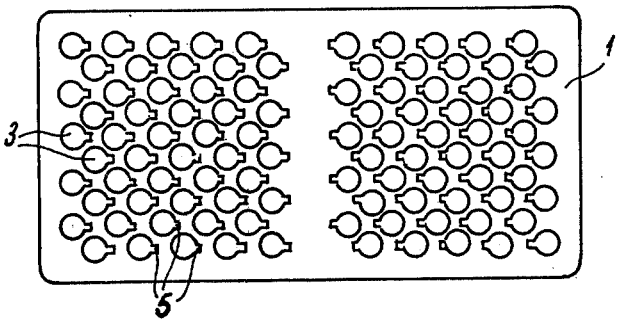
FIGS. 3 and 4 are top and bottom views, respectively, of the base and cover according to this invention.
Figure 4:
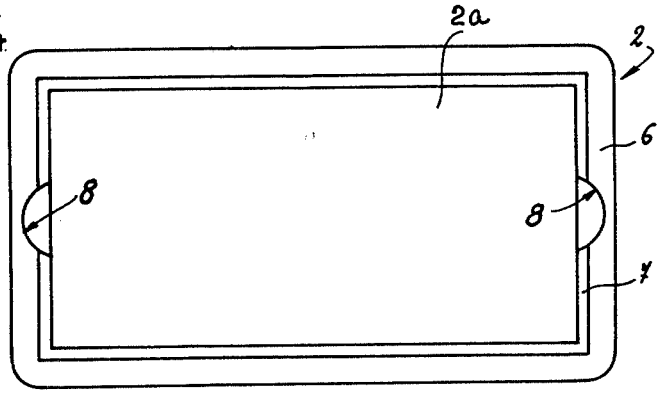

As shown in FIGS. 1–4 the container according to this invention basically comprises a rectangular base 1 over which is fitted a rectangular cover 2. The base 1 is formed with an array of staggered cylindrical blind recesses 3 each adapted to receive a respective cartridge 4, here a blank, and each opening at the upper surface 1*a* of the base 1. Each of these recesses 3 has a stepped upper portion 9 adapted to receive the rim of the respective blank 4. Furthermore each of the recesses 3 is formed along its full axial or vertical length with a rectangular-section radial extension 5 extending from the base 3*a* of each recess 3 to the surface 1*a*.

Figure 5:
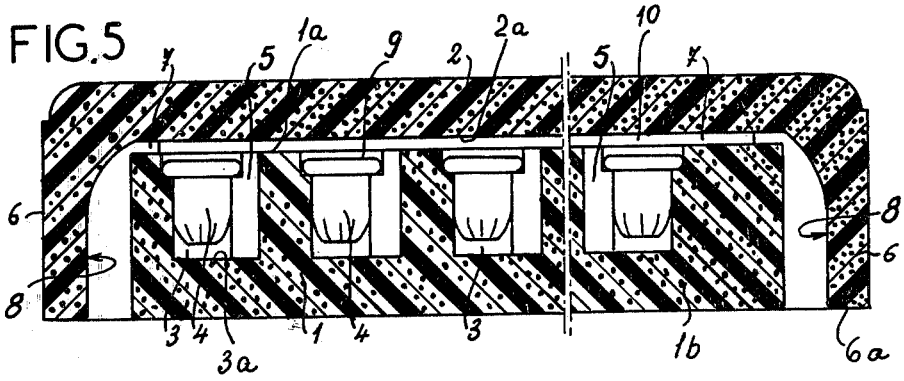
FIG. 5 is a section taken along line V—V of FIG. 1.

The cover 2 is formed with a downwardly extending skirt 6 terminating at its lower edge 6*a* at the plane of the lower surface 1*b* of the base 1 in the assembled condition shown in FIG. 5. Inwardly of this skirt 6 the cover 2 is formed with a ridge 7 extending all the way around the skirt 6 and adapted to rest on the outermost edge of the surface 1*a* of the base 1. In the middle of each of its short opposite side portions the skirt 6 is formed with a part-cylindrical groove 8 extending from the rim 6*a* all the way up to the inner face 2*a* of the cover 2.

The ridge 7 spaces the surfaces 1*a* and 2*a* apart so that air can pass from each of the cartridges 4 up through the extension 5, out through the space 10 defined between the surfaces 1*a* and 2*a*, and downwardly through the grooves 8. Thus the cartridges 4 can easily dry. At the same time there is no lateral interconnection between the recesses 3 below the surface 1*a* so that a chain explosion is largely impossible.

The recesses 3 also make it relatively easy to pull the base 1 out of the cover 2. The user need merely engage his or her thumbnail in one of the grooves 8 and a fingernail in the opposite groove 8 and then pull the base 1 from the cover 2.

The two parts 1 and and 2 are here both made of foamed polystyrene. The outer dimensions of the base 1 are made to correspond closely to the inner dimensions of the cover 2 for a snug fit. The cushioning effect of the polystyrene makes the package thus formed extremely safe, and allows the recesses 3 to be formed so as tightly to receive the respective cartridges 4. The extensions 5 of the recesses 3 allow, if necessary, a cartridge 4 to be easily pried out of a base 1.

I claim:

1. A container for holding a plurality of explosive cartridges, said container comprising:

a base part having an upper face and formed with a plurality of blind recesses each having a shape generally complementary to that of one of said cartridges but formed along its full height with an extension and each opening upwardly only at said face, whereby a cartridge fitted in any of said recesss is aired at the respective extension;

a cover part having a lower face juxtaposable with said upper face;

a ridge formed on one of said faces and engageable with the other face to space same apart;

a skirt on one of said parts engaging past and around the other of said parts; and a formation on said one part and on said ridge and forming an open passage extending from between said faces to an edge of said skirt, whereby the space between said faces is open to the outside through said passage.

2. The container defined in claim 1 wherein said one face is on said one part and said formation is a groove formed in said skirt and extending across said ridge.

3. The container defined in claim 2 wherein each of said recesses is generally cylindrical and each of said extensions projects radially from the respective recess and imparts to same a keyhole section.

4. The container defined in claim 3 wherein said base part is a block of synthetic-resin foam.

5. The container defined in claim 3 wherein said base and cover parts are both generally rectangular.

6. The container defined in claim 5 wherein said cover part is formed with two such grooves directly opposite each other.

7. The container defined in claim 3 wherein said skirt extents beyond said ridge by a distance equal substantially to the height of said base part, said base part having a bottom surface generally coplanar with the rim of said skirt when said base part is fitted into said cover part.

8. The container defined in claim 7 wherein said ridge is formed as a step in said cover part at said skirt.

9. The container defined in claim 7 wherein said base and cover parts are generally rectangular and similar and said skirt has four side portions, said cover part being formed with two such grooves each at a respective side portion and opposite each other.

10. The container defined in claim 7 wherein said recesses each have a depth substantially greater than the length of the respective cartridge.

* * * * *